United States Patent [19]

La Bate et al.

[11] 4,186,908

[45] Feb. 5, 1980

[54] EXPANDABLE HOT TOP FOR INGOT MOULDS

[75] Inventors: Micheal D. La Bate, Ellwood City; Joseph A. Perri, Coraopolis, both of Pa.

[73] Assignee: Insul Company, Inc., East Palestine, Ohio

[21] Appl. No.: 910,866

[22] Filed: May 30, 1978

[51] Int. Cl.[2] ..... B22D 7/10

[52] U.S. Cl. ..... 249/197

[58] Field of Search ..... 249/197, 198, 106

[56] References Cited

U.S. PATENT DOCUMENTS

| | | | |
|---|---|---|---|
| 1,913,847 | 6/1933 | Messler | 249/197 |
| 2,361,386 | 10/1944 | Eayrs | 249/197 |
| 3,468,368 | 9/1969 | Charman, Jr. et al. | 164/359 |
| 3,797,801 | 3/1974 | Mueller | 249/197 |
| 3,836,112 | 9/1974 | Jago et al. | 249/197 |

*Primary Examiner*—Lester L. Lee

*Attorney, Agent, or Firm*—Webster B. Harpman

[57] ABSTRACT

An expandable hot top for use in ingot moulds has six panels hinged to one another, two pairs of which are arranged to be folded inward with accordion-like folds for simplified placement and registry within the ingot mould and to form a compact flat form for shipping.

5 Claims, 3 Drawing Figures

EXPANDABLE HOT TOP FOR INGOT MOULDS

BACKGROUND OF THE INVENTION (1) Field of the Invention

This invention relates to hot tops as used in conjunction with ingot moulds to form a heat insulating and heat adding extension at the top of the ingot mould which serves to retain a bath of molten metal in the top of the mould during the solidification of the ingot poured therein. The effect of such an action is to prevent or minimize piping and formation of other defects in the ingot being poured as it cools.

(2) Description of the Prior Art

Prior hot tops have relied on a series of panels of equal length hinged to one another in a chain-like configuration. See for example U.S. Pat. Nos. 2,361,386, 3,468,368 and 3,836,112.

In U.S. Pat. No. 2,361,386, a series of separate panels are linked to one another. In the present invention, two pairs of two distinctly different panels form an expandable endless belt-like structure.

U.S. Pat. No. 3,468,368 discloses a multiple panel assembly fastened together which can be arranged to form a hot top for insertion into an ingot mould. In the present invention, an inwardly folding expandable hot top is disclosed and arranged for mechanical expansion within an ingot mould for sealing relation with the mould.

In U.S. Pat. No. 3,836,112, a flat folded hot topping assembly is described wherein two hinged sections of material are each scored midway from either end. In the present invention, six panels are hinged to one another to provide an outwardly expandable accordiontype folding action to shape and position the hot top thus formed.

SUMMARY OF THE INVENTION

An expandable hot top for use in ingot moulds has multiple sections hinged to each other to provide outwardly folding expandable mechanical action as the hot top is formed within the ingot mould.

DESCRIPTION OF THE PREFERRED EMBODIMENT

Figure 1:
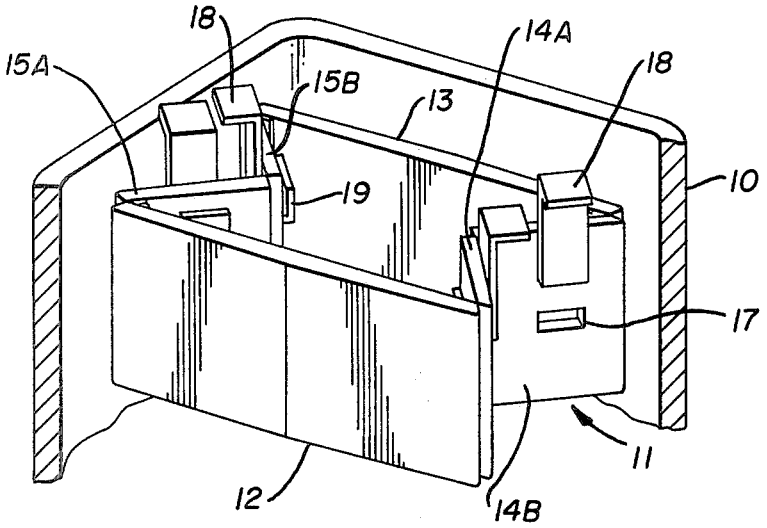
FIG. 1 is a perspective view of a portion of an ingot mould showing a partially unfolded hot top therein.
Figure 2:
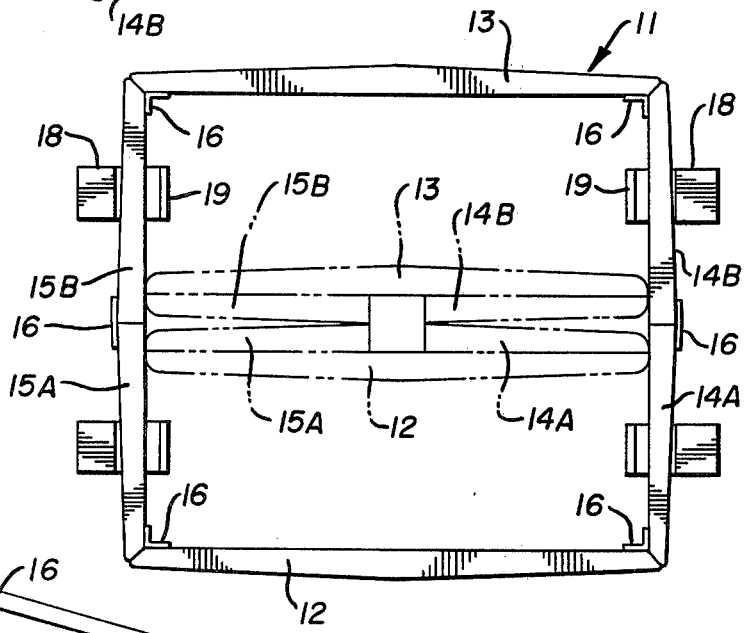
FIG. 2 is a top plan view of the fully expanded hot top.
Figure 3:
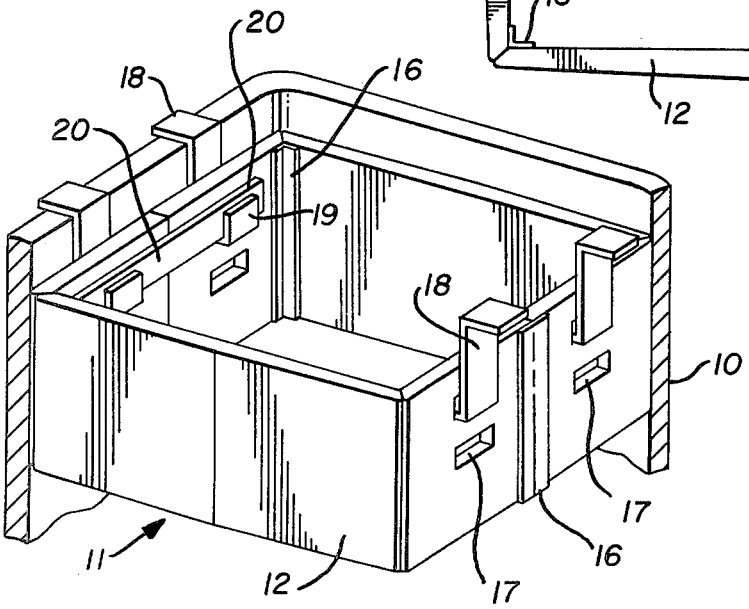
FIG. 3 is a perspective view of a portion of an ingot mould showing a fully expanded hot top therein.

Referring now to FIG. 1 of the drawings, it will be seen that a portion of an ingot mould 10 is shown with an expandable, consumable hot top 11 therein comprising two oppositely disposed identical side panels 12 and 13 and two pairs of oppositely disposed end panels 14A and 14B, 15A and 15B; the panels of each pair being hinged by a flexible material 16 to one another and to the ends of the side panels 12 and 13 as best seen in FIG. 2 of the drawings. The two pairs of end panels 14A and 14B, 15A and 15B have at least one aperture 17 therein. Z-shaped hangers 18 having upturned lower ends 19 are positioned in the apertures 17 so as to support the hot top 11 in expanded position in the ingot mould 10 as best seen in FIG. 3 of the drawings. By referring now to FIG. 2 of the drawings, the expandable hot top is shown in solid lines in fully expanded position wherein each of the end panels 14A and 14B and 15A and 15B have been moved mechanically into end-to-end relation, thereby forming a conventionally-shaped hot top with the side panels 12 and 13 in abutting relation with the end panels 14A and 14B and 15A and 15B. It will be seen that the hinges of flexible material 16 are shown on the inner corners of the hot top 11 at the ends of the side panels 12, 13 and on the outer sides of the ends of the end panels 14A and 14B and 15A and 15B, respectively. Still referring to FIG. 2 of the drawings, a broken line illustration of the expandable hot top 11 may be seen with the hot top 11 in its collapsed or folded position with each of the pairs of end panels 14A and 14B and 15A and 15B, respectively, in face-to-face engagement with the side panels 12, 13.

The accordion-type folding action of the aforementioned panels allow for a semi-flat configuration for shipping and simplified placement within the ingot mould 10. As will be seen in FIG. 3 of the drawings, the expanded hot top 11 is shown in place within a portion of an ingot mould 10. Retainer locking bars 20 are positioned across the inside portions of the end panels 14A and 14B and 15A and 15B between the upturned ends 19 of the Z-shaped hangers 18, thereby locking the hot top 11 in an expanded position. The action of the mechanical expansion of the hot top 11 helps support the hot top within the ingot mould 10. It is this expanding action that also forms a seal between the inside of the mould 10 and the hot top 11 preventing molten metal from rising between the ingot mould 10 and the hot top 11 and floating said hot top out of the mould.

Those skilled in the art will observe that the side and end panels 12, 13, 14A and 14B, 15A and 15B, respectively, of the consumable hot top 11 are preferably formed of a consumable material having a known time of consumability. The material comprising, for example, a mixture of 16% sawdust, 54% dolomite with 30% sodium silicate as a binder. Various other combinations of consumable hot top ingredients may also be used.

Although but one embodiment of the present invention has been illustrated and described, it will be apparent to those skilled in the art the various modifications and changes may be made herein without departing from the spirit of the invention.

Therefore We claim:

1. An expandable hot top for ingot moulds comprising two pairs of preshaped end panels, flexible means hinging said end panels to one another, two preshaped side panels, flexible means hinging said side panels to said end panels in an arrangement wherein the two pairs of end panels fold inwardly against each other to a position between the side panels, hangers with inturned and upturned lower ends and outturned upper ends positioned in apertures in said end panels, whereby movement of the end panels into end-to-end to end relation, moves the side panels outwardly to form the hot top, locking bars positioned across the inside of said end panels between and in engagement with the upturned ends of the hangers hold the hot top in expanded open position in the ingot mould.

2. The expandable hot top in claim 1 wherein the flexible means hinging said end panels is located on the outer side thereof and the flexible means hinging the side panels to the end panels is located on the inside thereof.

3. The expandable hot top of claim 1 wherein the end panels are arranged so as to engage the side panels in abutting relation.

4. The expandable hot top of claim 1 wherein there are at least two vertically spaced apertures in each of said end panels so as to enable the hangers to be positioned in different vertical locations relative to the hot top.

5. The expandable hot top of claim 1 wherein the panels are formed of consumable material having a known time of consumability.

* * * * *